United States Patent [19]

Economy et al.

[11] Patent Number: 4,520,647

[45] Date of Patent: Jun. 4, 1985

[54] SURFACE FINISHING PROCESS

[75] Inventors: James Economy, San Jose; Anagnostis E. Zachariades, Hillsborough, both of Calif.

[73] Assignee: International Business Machines Corporation, Armonk, N.Y.

[21] Appl. No.: 528,351

[22] Filed: Aug. 31, 1983

[51] Int. Cl.[3] ..... B21B 3/00

[52] U.S. Cl. ..... 72/365; 72/379

[58] Field of Search ..... 72/365, 366, 379; 419/26, 28; 264/284

[56] References Cited

U.S. PATENT DOCUMENTS 3,839,893 10/1974 Appel et al. ..... 72/379

4,481,876 11/1984 Amendola ..... 264/284

*Primary Examiner*—Lowell A. Larson

*Attorney, Agent, or Firm*—Thomas R. Berthold; Walter J. Madden, Jr.

[57] ABSTRACT

A method for modifying the surface properties of a material which applies a deformational force which exceeds the elastic limit of the material at the surface so that a plastic deformation of the surface occurs without modifying the bulk properties of the material.

2 Claims, 5 Drawing Figures

AS RECEIVED Al Mg SUBSTRATE REINFORCED WITH Si $C_3$ WHISKERS AFTER ROLLING

AS RECEIVED Al Mg SUBSTRATE REINFORCED WITH $SiC_4$ WHISKERS

AS RECEIVED Al Mg SUBSTRATE REINFORCED WITH $SiC_4$ WHISKERS AFTER ROLLING

As received Al-Mg Substrate
after diamond turning

As received Al-Mg Substrate
before diamond turning

As received Al-Mg Substrate
after cold-rolling

SURFACE FINISHING PROCESS

CROSS REFERENCE TO RELATED PATENT APPLICATIONS

Copending application Ser. No. 528,318, filed concurrently herewith on Aug. 31, 1983 discloses a method for producing improved magnetic properties in a recording disk employing either static or dynamic pressure.

BACKGROUND AND FIELD OF INVENTION

This invention relates to methods for processing articles to modify the surface properties thereof. It applies to plastically deformable surfaces of material substrates or on substrates or surfaces which can be rendered plastically deformable under an appropriate choice of processing conditions.

DESCRIPTION OF PRIOR ART

There are a number of methods for modifying the properties of a surface including calendering and burnishing. Calendering is primarily a shaping process usually accomplished using one or more pairs of pressure rollers between which the material to be treated is passed, a reduction being effected in the thickness of the material as well as a lengthening and widening thereof.

In burnishing, which is employed primarily for polishing, there is physical contact between the treated material and the burnishing element, with the burnishing force primarily tangential to the material surface and resulting in a relatively aggressive working of the material surface as a result of the much higher shearing forces employed.

There are a number of applications where it is desirable to modify the surface properties of a material without stock removal or producing any changes in other physical properties of the material such as thickness, length, diameter or surface flatness and without any work hardening of the material. For example, in the manufacture of magnetic recording disks, it has been customary to use a metallic substrate member, such as an AlMg alloy, on which to deposit the magnetic recording layer. To obtain the desired surface finish on the substrate, some type of relatively expensive machining operation has been required, such as diamond turning on a lathe, or a grinding operation usually followed by a polishing step.

Also in the semiconductor technology, polymeric coatings used as dielectric insulators on ceramic substrates yield conformal coatings, i.e. coatings which conform to the underlying surface. On the other hand, there is a need to achieve planar coatings over topographies to permit development of multilevel metal lines on semiconductor devices. This may require the use of exotic polymeric formulations which can flow readily and result in evenly deposited thin coatings. The synthesis of such formulations require extensive and expensive laboratory preparations.

SUMMARY OF THE INVENTION

In accordance with the present invention, a surface deformation is produced on a material through pressure rollers to produce the desired surface finish without any significant change in other physical properties of the material and without speed differential between the treated material and the rollers.

DESCRIPTION OF THE PREFERRED EMBODIMENT

In the present invention, the surface deformation is produced through the action of pressure roller members having ultra-smooth hard surfaces which bear against the surfaces to be deformed. The result is that the surface finish of the treated member replicates that surface finish of the rollers. In a preferred embodiment, the roller members are a pair of rotating conical rollers, of a suitable material such as hardened tool steel, silicon carbide or aluminum oxide, having ultra-smooth surfaces of a hardness greater than that of the treated member between which the member to be treated is placed, rotation of the conical rollers resulting in rotation of the treated member between the rollers at the same angular velocity as the rollers. This configuration is particularly adapted for use with materials having circumferential symmetry, such as a disk substrate.

The pressure applied by the rollers is below the yield stress of the bulk substrate, but is sufficient to exceed the elastic limit of the relatively rough micro surfaces being treated so as to result in irreversible deformation of the treated surfaces. Another important aspect of this invention is that only a relatively small depth of the treated surface, in the order of a few microns, and preferably one micron or less, is affected and there is no change in the bulk properties and dimensions of the remainder of the treated member.

The invention may be employed as indicated above for modifying the surface properties of a wide range of materials including metals, polymers, ceramics and composite materials. Composites include materials which are mixtures or layered structures. Examples are Al alloys, Al reinforced with SiC whiskers or fiber reinforced or filled polymeric formulations, or thin polymer coatings on silicon or ceramic substrates. Unexpectedly, cross-linked polymers such as epoxies can be made to display plastic deformation at the surface, although the surface of uncross-linked or partially cross-linked epoxy will deform under milder conditions. An important aspect of this invention is the ability to use higher temperatures to achieve the optimum surface smoothing within a certain time and load.

Figure 1:
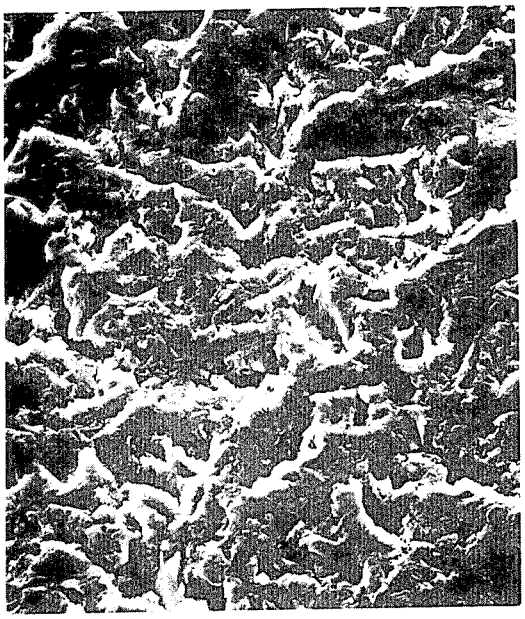
FIGS. 1–5 are photographs from a Scanning Electron Microscope (SEM) showing the unexpected changes in properties of surfaces treated in accordance with the present invention, in comparison with the prior art techniques.
Figure 2:
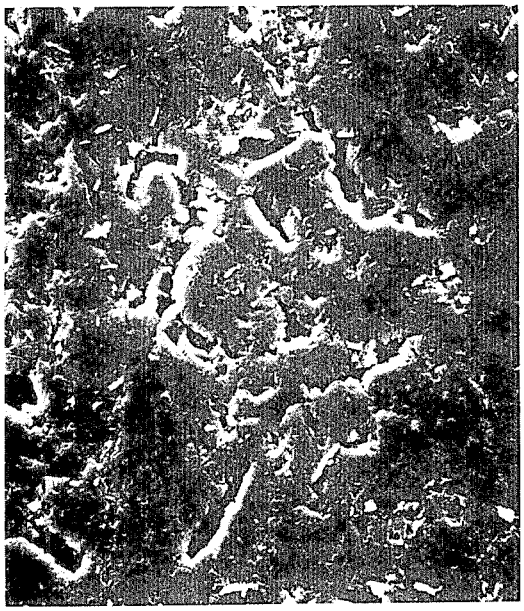

The SEM photograph of FIG. 1 shows an as-received Al substrate reinforced with SiC whiskers, and FIG. 2 shows its appearance after treatment in accordance with the present invention. The contrast between the surfaces in FIGS. 1 and 2 shows the unexpected improvement in surface properties by the method of the present invention without altering the bulk physical properties of the treated member. The material shown in FIG. 2 had a load force of 200 pounds applied to its surface at room temperature for three minutes, and a change in the surface smoothness could be observed as the treatment progressed.

Profilometer readings of the surfaces of different materials illustrate the effectiveness of the method of this invention, and in fact show that the surface smoothness of the treated surfaces approaches the surface smoothness of the hard material used as the rollers.

Figure 4:
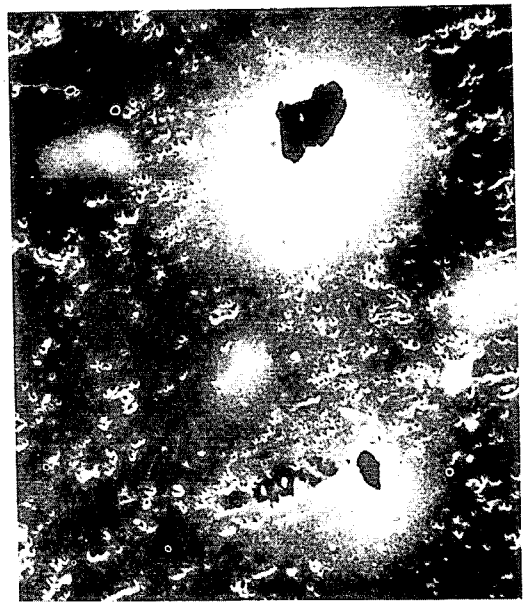
Figure 3:
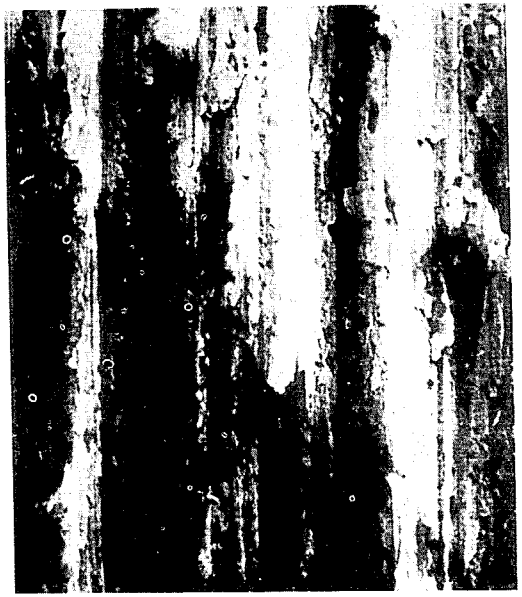
Figure 5:
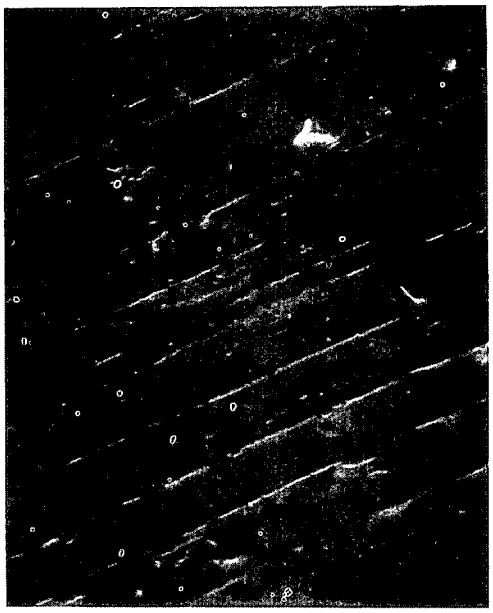

The invention may also be employed, as indicated above, for modifying the surface properties of AlMg magnetic recording disk substrates, as an alternate to diamond turning or grinding. The SEM photographs of FIGS. 3 and 4 show an as-received AlMg substrate surface and that surface after receiving a conventional diamond turning. In contrast, FIG. 5 shows the appearance of an as-received AlMg surface after treatment in accordance with the present invention. The contrast between the surfaces in FIG. 4 and FIG. 5 graphically shows the unexpected improvement in surface properties produced by the method of the present invention.

Outstanding points of this technique are:

1. It is a simplified process and can replace currently used diamond turning, grinding and polishing processes.
2. It achieves a very high surface ultrafinish by surface deformation only, without stock removal and without significant working of the treated surface. The surface smoothness in preliminary tests is close to 2–4 $\mu$m as determined by Talystep measurements.
3. Two surfaces can be treated simultaneously, in contrast to the inherent one surface-at-a-time method of diamond turning and grinding.
4. Elimination of debris associated with stock removal methods represents an intrinsic advantage of the rolling process, since such debris frequently adheres tightly to the surface.
5. Lower load forces are required than in other surface treatment methods, minimizing problems of bulk deformation and/or surface working.

It will be apparent to those skilled in the art that the technique of the present invention is applicable to modify the surface properties of a large number of materials. The major feature of the present invention is the application to the treated material of a deformational force which exceeds the elastic limit of the treated surface so that plastic deformation of the treated surface results, this deformation affecting only a small depth of the surface without modification of the bulk properties of the material.

We claim:

1. A method for simultaneously modifying the rough micro surfaces on opposite faces of a recording disk substrate, the rough micro surfaces extending beyond the bulk thickness of the substrate, comprising the steps of:

placing the substrate between a pair of rollers, said rollers having a surface finish smoother than the rough micro surfaces of the substrate, the hardness of the surfaces of said rollers exceeding the hardness of the rough micro surfaces to be modified, and applying through said rollers a deformational force to the rough micro surfaces to be modified which exceeds the elastic limit of the rough micro surfaces to be modified to produce plastic deformation thereof, said deformation extending into the rough micro surfaces no greater than approximately four microns, without lessening the bulk thickness of the substrate or otherwise modifying the bulk properties of the substrate.

2. A method in accordance with claim 1 in which said rollers rotate at the same rate as the substrate during application of said deformational force.

* * * * *